US005080077A

United States Patent [19]

Sawert et al.

[11] Patent Number: 5,080,077

[45] Date of Patent: Jan. 14, 1992

[54] MODULAR FUEL DELIVERY SYSTEM

[75] Inventors: Ulf Sawert, Grand Blanc; Timothy F. Coha, Davison; Dennis P. McGrath, Ortonville, all of Mich.

[73] Assignee: General Motors Corporation, Detroit, Mich.

[21] Appl. No.: 531,737

[22] Filed: Jun. 1, 1990

[51] Int. Cl.[5] ..... F02M 37/04; E03B 11/00

[52] U.S. Cl. ..... 123/514; 137/590; 137/574; 123/509

[58] Field of Search ..... 123/514, 509, 510, 516; 137/590, 565, 592, 574, 576; 417/360

[56] References Cited

U.S. PATENT DOCUMENTS

| | | | |
|---|---|---|---|
| 4,750,518 | 6/1988 | Griffin | 137/590 |
| 4,763,684 | 8/1988 | Kelch | 123/514 |
| 4,831,990 | 5/1989 | Tuckey | 123/514 |
| 4,834,132 | 5/1989 | Sasaki | 123/514 |
| 4,869,225 | 9/1989 | Nagata et al. | 123/509 |
| 4,886,031 | 12/1989 | Scheurenbrand | 123/514 |
| 4,928,657 | 5/1990 | Asselin | 123/509 |
| 4,945,884 | 8/1990 | Coha | 123/514 |

FOREIGN PATENT DOCUMENTS 2844053 4/1980 Fed. Rep. of Germany ..... 123/509

*Primary Examiner*—Carl S. Miller
*Attorney, Agent, or Firm*—Saul Schwartz

[57] ABSTRACT

A modular fuel delivery system including a reservoir in fuel tank, an electric high pressure pump in the reservoir fed only from inside the reservoir, and a jet pump fed only from the fuel tank and discharging into the reservoir to keep the latter filled and energized from the high pressure pump. A check valve is disposed between the jet pump inlet and the fuel tank to prevent backflow into the fuel tank. A partition on the bottom of the reservoir separates the jet pump discharge from the high pressure pump inlet and defines a standpipe around and above the jet pump discharge so that the jet pump stays submerged in fuel when the high pressure pump empties the reservoir. The pumping efficiency of the jet pump when submerged is better than when dry so that the delay in restarting the engine after the both the fuel tank and the resvoir are pumped empty is minimized.

3 Claims, 2 Drawing Sheets

MODULAR FUEL DELIVERY SYSTEM

FIELD OF THE INVENTION

This invention relates to automotive modular fuel delivery systems including an in-tank reservoir, a high pressure pump in the reservoir, and a jet pump for filling the reservoir.

BACKGROUND OF THE INVENTION

In automotive modular fuel delivery systems such as described in U.S. patent application Ser. No. 426631, filed Oct. 24, 1989 by Coha et al and assigned to the assignee of this invention, a cannister-like reservoir in a fuel tank encloses an electric, high pressure fuel pump fed only from inside the reservoir. Advantages of such systems included modular handling and installation of fuel system components and minimization of the likelihood of fuel starvation at the high pressure pump inlet when the vehicle turns a corner. Various proposals have been advanced for keeping the reservoir full In U.S. Pat. No. 4860714, for example, a jet pump at the bottom of the reservoir pumps fuel from the tank into the reservoir and is powered by a fraction of the discharge of the high pressure pump. The delay in restarting the engine with a limited quantity of fuel after the jet pump pumps the fuel tank dry and the high pressure pump pumps the reservoir dry is undesirably maximized if, as in the aforesaid U.S. Pat. 4860714, the jet pump is dry at the beginning of the restart sequence. In a modular fuel delivery system according to this invention, the jet pump is maintained submerged to minimize the delay in restarting the engine.

SUMMARY OF THE INVENTION

This invention is a new and improved modular fuel deliver system including a reservoir in a fuel tank, an electric, high pressure pump in the reservoir fed only from inside the reservoir, and a jet pump for pumping fuel from the tank into the reservoir. In the modular fuel delivery system according to this invention, a check valve prevents backflow from the jet pump into the fuel tank and the discharge of the jet pump is located in a standpipe the top of which is above the discharge so that jet pump stays submerged when the reservoir is emptied. In a preferred embodiment of the modular fuel delivery system according to this invention, the jet pump discharge is at the bottom of the reservoir and the standpipe is defined by a partition in the reservoir separating the jet pump discharge and the high pressure pump inlet.

DESCRIPTION OF A PREFERRED EMBODIMENT

Figure 1:
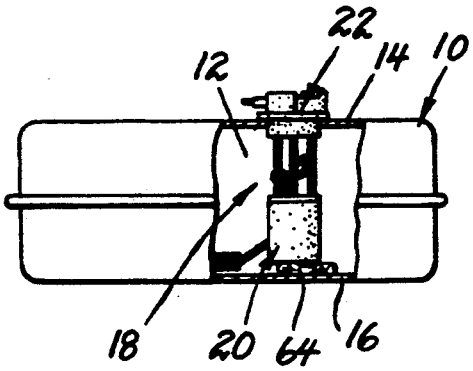
FIG. 1 is a partially broken-away elevational view of an automobile fuel tank having installed thereon a modular fuel delivery system according to this invention.
Figure 2:
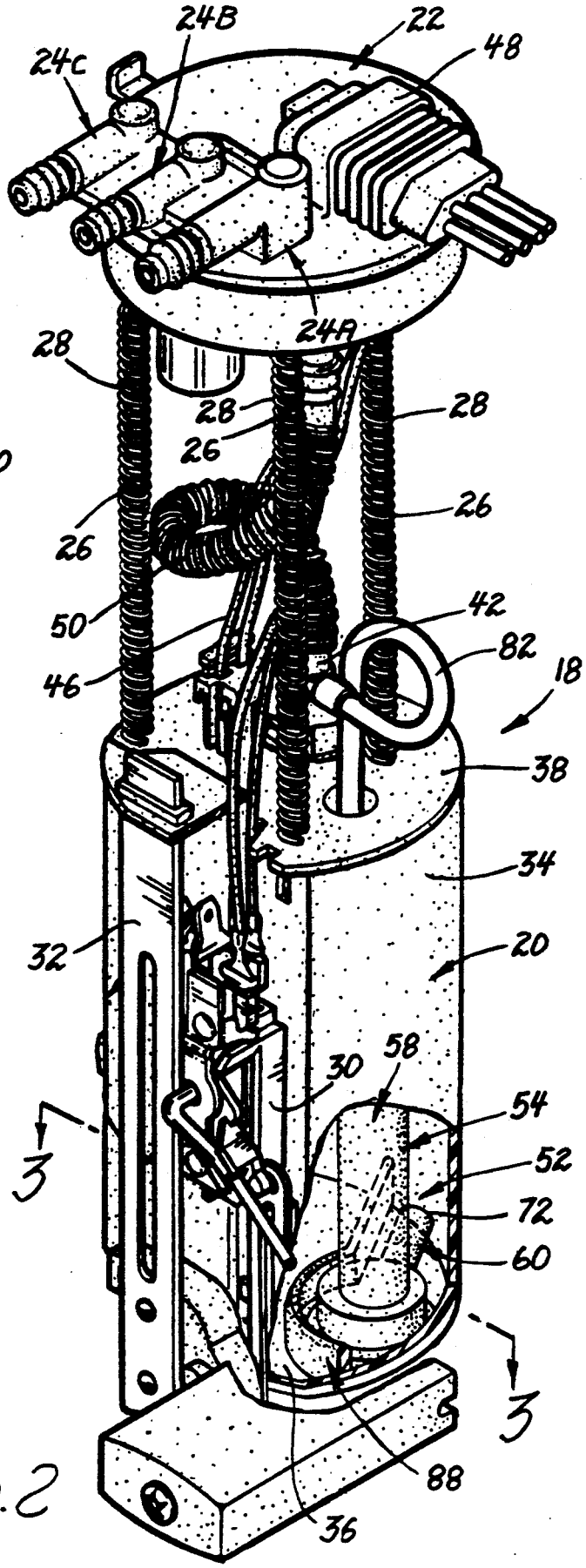
FIG. 2 is a partially broken-away perspective view of the modular fuel delivery system according to this invention.

Referring to FIGS. 1 and 2, a fuel tank 10 of an automobile, not shown, has an internal volume or fuel chamber 12 defined between a top 14 and a bottom 16 of the tank. The top 14 has a hole or access port therein for installation of a modular fuel delivery system 18 according to this invention.

The modular fuel delivery system 18 includes a canister-like plastic reservoir 20 and a plastic cover 22. The cover 22 closes the top access port in the fuel tank and has a plurality of fluid connectors 24A–C thereon for attachment, respectively, to a high pressure hose to the engine, a vapor purge, and a low pressure return hose from the engine A plurality of tubular struts 26 attached to the cover 22 are telescopically received in the reservoir so that the reservoir and the cover are movable toward and away from each other. One of the tubular struts is connected through the cover 22 to the connector 24C and defines a fuel return duct to the reservoir. A plurality of springs 28 around the struts urge relative separation between the cover and the reservoir. When the cover is attached to the top 14, the springs 28 hold the reservoir against the bottom 16. A bottom referenced fuel level sensor 30 is mounted on a side bar 32 attached to the reservoir.

Figure 3:
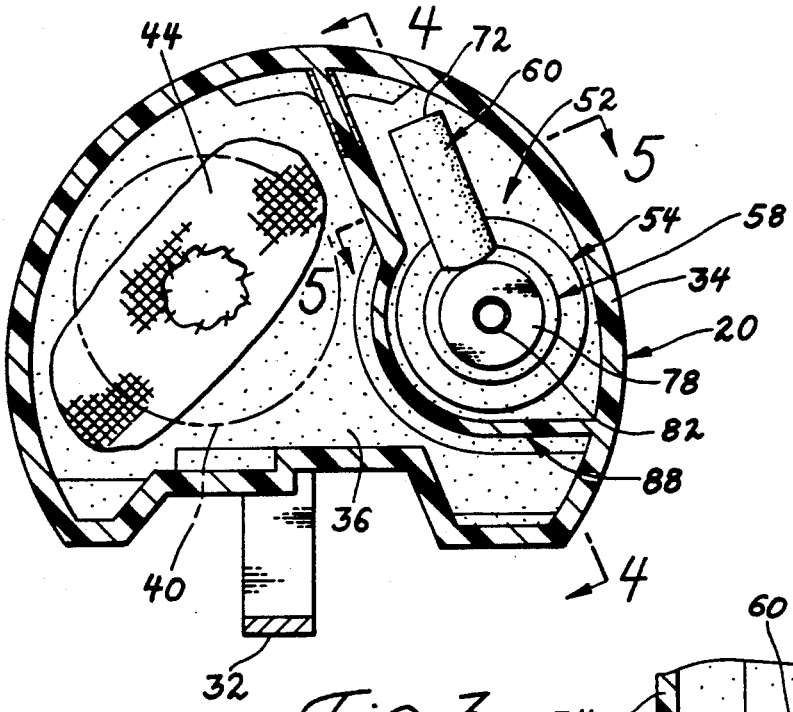
FIG. 3 is a plan view taken generally along the plane indicated by lines 3—3 in FIG. 2.

The reservoir 20 has a cylindrical side 34 and a generally flat bottom 36. A plastic retainer 38, FIG. 2, closes the reservoir. A schematically represented electric, high pressure fuel pump 40, FIG. 3, is suspended inside the reservoir 20 from a high pressure connector 42, FIG. 2, on the retainer 38. Near the bottom of the reservoir, the high pressure pump has an inlet, not shown, covered by a secondary screen 44, FIG. 3. The inlet of the high pressure pump is fed through the secondary screen only from inside the reservoir. An intermediate wiring harness 46 connects the high pressure pump 40 and the fuel level sensor 30 to the main wiring harness, not shown, of the vehicle through an electrical connector 48 on the cover 22. A high pressure hose 50 extends between the high pressure connector 42 and the connector 24A on the cover 22.

The modular fuel delivery system 18 further includes a jet pump 52 in the reservoir 20. A plastic housing 54 of the jet pump has a cylindrical mounting flange 56, FIG. 4, an inlet section 58 perpendicular to the bottom 36 of the reservoir, and a discharge section 60 parallel to the bottom 36. The cylindrical flange 56 fits in an aperture 62 in a raised portion of the bottom of the reservoir and is welded or otherwise sealingly attached to the reservoir. A primary screen 64 is attached to the cylindrical flange 56 and rests on the bottom 16 of the fuel tank. The inlet section 58 has an internal passage 66 which opens into a valve chamber 68 in the housing 54. The discharge section 60 has an internal, expanding diameter venturi passage 70 therein extending from the valve chamber 68 to a discharge end 72 at the end of the discharge section 60.

A perforated, plastic check valve seat 74 is rigidly connected to the cylindrical flange 56 of the jet pump housing and supports a reciprocating or equivalent check valve element 76. The valve element 76 has a closed position, FIG. 4, covering the perforations in the valve seat 74 and an open position, not shown, exposing the perforations. In the open position of the valve element 76, fuel flows from the fuel chamber 12 into the valve chamber 68 through the primary screen 64 and through the perforations in the valve seat. In the closed position of the valve element, backflow from the valve chamber 68 into the fuel chamber 12 is foreclosed.

A fluid connector 78 is press fitted onto the upper end of the inlet section 58 of the jet pump housing and supports a strainer 80 in the internal passage 66. A jet pump tube 82 extends between the fluid connector 78 and the high pressure connector 42 on the retainer 38 and conducts a fraction of the discharge of the high pressure pump 40 to the internal passage 66 of the jet pump. A brass nozzle 84 with an orifice 86 therein is press fitted on the housing 54 at the lower end of the internal passage 66 with the orifice 86 facing the venturi passage 70. The fraction of the discharge of the high pressure pump conducted to the internal passage 66 by the jet pump tube 82 exits the orifice 86 into the venturi passage 70 as a high velocity stream parallel to the bottom 36 of the reservoir. In conventional jet pump fashion, the high velocity stream entrains and conducts fuel from the valve chamber 68 into the reservoir 20 through the venturi passage 70. In appropriate application, the jet pump could be energized by return flow from the engine as described in British Patent 1591978, complete specification published Dec. 31, 1980.

Figure 5:
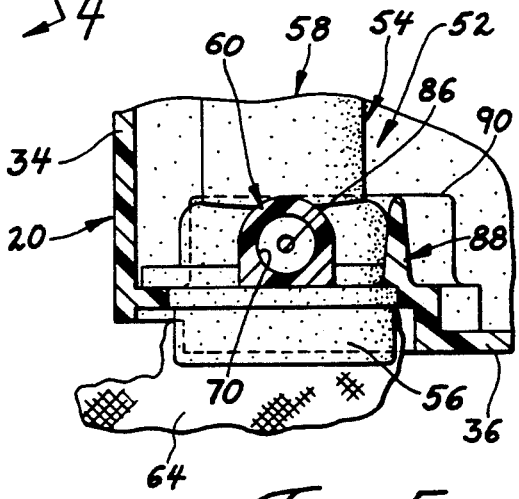
FIG. 5 is view taken generally along the plane indicated by lines 5—5 in FIG. 3.
Figure 4:
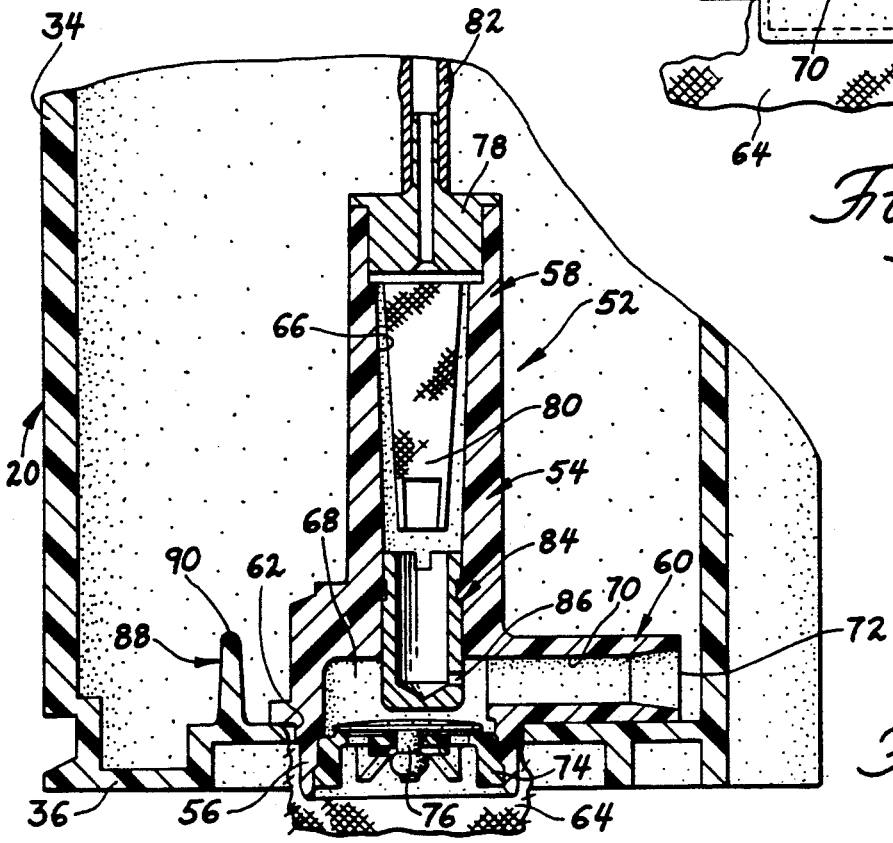
FIG. 4 is view taken generally along the plane indicated by lines 4—4 in FIG. 3.

As seen best in FIGS. 3–5, the primary screen 64 and the inlet to the high pressure pump 40 are separated from the discharge end 72 of the discharge section of the jet pump by a partition 88 integral with the bottom 36 and side 34 of the reservoir The partition 88 has an upper edge 90 above the discharge end 72 and cooperates with the side 34 of the reservoir in defining a fluid standpipe around the discharge section 60 of the jet pump higher than the discharge end 72

Normally, the jet pump 52 pumps enough fuel to keep the reservoir 20 filled regardless of the flow rate out of the reservoir from the high pressure pump. Without refueling, however, the jet pump 52 empties the fuel chamber 12 to below the lower edge of the cylindrical flange 56. Thereafter, the high pressure pump empties the reservoir to below the inlet to the high pressure pump, a level below the upper edge 90 of the partition. The standpipe defined by the partition 88 and side 34 of the reservoir traps or captures a pool of fuel around the discharge section 60 of the jet pump to a level above the discharge end 72. The check valve element 76 prevents the captured fuel in the standpipe from draining back into the fuel chamber 12.

When the engine stops after the reservoir and fuel tank are emptied as described above, only a gallon or less of fuel is usually available to restart the engine. That small quantity of fuel is not usually sufficient for self-migration past the check valve element 76 into the reservoir to a level above the inlet to the high pressure pump. Accordingly, a delay is experienced in restarting the engine until enough fuel is pumped by the jet pump 52 into the reservoir to prime the high pressure pump.

The partition 88 minimizes the delay in restarting the engine. More particularly, the unprimed high pressure pump discharges vapor into the high pressure connector 42 and, through the jet pump tube 82, into the internal passage 66 in the inlet section 58 of the jet pump. The vapor exits the orifice 86 into the venturi passage 70 as a vapor jet. The vapor jet is submerged in the fuel captured in the standpipe defined by the partition 88 and, therefore, virtually immediately commences entraining or pumping fuel into the reservoir, albeit at reduced efficiency. The fuel overflows the upper edge 90 of the partition 88 and rises in the remainder of the reservoir until the high pressure pump is primed Then, the high pressure pump commences pumping fuel to the engine for restart and to the jet pump which thereupon achieves full pumping efficiency for rapid filling of the reservoir to sustain the engine.

In the absence of the partition 88, the delay in restarting engine is longer. That is, without the partition, the high pressure pump 40 empties the reservoir 20 to below the discharge end 72 of the discharge section of the jet pump after the jet pump empties the fuel chamber 12. Therefore, the jet pump is essentially dry at the commencement of the restart sequence described above and operating at minimum efficiency because the vapor jet emanating from the orifice 86 defines a high velocity vapor stream into essentially only vapor rather than into liquid fuel as occurred with the partition 88 in place. Tests comparing a modular fuel delivery system without a standpipe-defining partition in place to an identical modular fuel delivery system according to this invention with a partition 88 in place demonstrated about a ten-fold improvement After adding 16 ounces of fuel to a pumped-empty fuel tank, the delay in restarting the engine was about 47 seconds for the modular fuel delivery system having a reservoir without a partition as compared to 4.7–6.0 seconds for an otherwise identical modular fuel delivery wherein the reservoir included the partition 88.

The embodiments of the invention in which an exclusive property or privilege is claimed are defined as follows:

1. A modular fuel delivery system comprising:

a reservoir in a fuel chamber of a fuel tank adjacent a bottom of said fuel tank, a high pressure pump in said reservoir having an inlet fed only from inside said reservoir, a jet pump in said reservoir having an inlet fed only from said fuel chamber and a discharge feeding only into said reservoir, means for energizing said jet pump with a fraction of the output of said high pressure pump so that said jet pump is supplied with fuel when said high pressure pump is operating primed and supplied with vapor when said high pressure pump is operating unprimed, means defining a check valve between said jet pump inlet and said fuel chamber for preventing backflow from said jet pump into said fuel chamber, and means in said reservoir defining a standpipe around and above said jet pump discharge separating said jet pump discharge from said high pressure pump inlet so that said jet pump remains submerged in fuel when said reservoir is emptied of fuel by said high pressure pump.

2. The modular fuel delivery system recited in claim 1 wherein said means defining in said reservoir a standpipe around and above said jet pump discharge includes a partition on a bottom of said reservoir having opposite ends sealingly connected to a side of said reservoir.

3. The modular fuel delivery system recited in claim 2 wherein said reservoir and said partition are plastic and molded integrally.

* * * * *